US005934790A

United States Patent [19]

Quintana et al.

[11] Patent Number: 5,934,790

[45] Date of Patent: Aug. 10, 1999

[54] PURSE LIGHT SYSTEM

[76] Inventors: Libby Quintana, 15360 Inwood Dr., Beaumont, Tex. 77713; Sherry L. Landry, 1913 W. Beverly St., Orange, Tex. 77632

[21] Appl. No.: 09/169,106

[22] Filed: Oct. 9, 1998

[51] Int. Cl.[6] ..... F21L 7/00

[52] U.S. Cl. ..... 362/191; 362/156; 362/276; 362/251; 362/200

[58] Field of Search ..... 362/251, 136, 362/154, 156, 276, 191, 200, 802, 396, 240

[56] References Cited

U.S. PATENT DOCUMENTS

| | | | |
|---|---|---|---|
| 4,084,085 | 4/1978 | Kim | 362/135 |
| 4,638,412 | 1/1987 | Weigert | 362/156 |
| 4,912,611 | 3/1990 | Lyle | 362/156 |
| 4,954,934 | 9/1990 | Kidder et al. | 362/156 |
| 5,005,111 | 4/1991 | Teal | 362/156 |
| 5,018,057 | 5/1991 | Biggs et al. | 362/156 X |
| 5,424,926 | 6/1995 | Myers | 362/156 |
| 5,444,605 | 8/1995 | Rivera | 362/156 |

*Primary Examiner*—Stephen Husar
*Attorney, Agent, or Firm*—Joseph N. Breaux

[57] ABSTRACT

A purse light system that is detachably mountable within a purse and that includes a lamp control circuit including an illumination lamp that is activated for a predetermined period of time by closing a momentary contact switch and which is not reactivateable until the momentary contact switch is released and the predetermined period of time has elapsed to prevent accidental draining of the light system battery power supply.

2 Claims, 2 Drawing Sheets

PURSE LIGHT SYSTEM

TECHNICAL FIELD

The present invention relates to illumination devices and more articularly to purse light system including hook and pile adhesive backed purse attachment strip with a peel off backing and a light assembly having a light housing that is securable to the purse attachment strip with a hook and pile housing fastener strip, companionate with the hook and pile purse attachment strip, provided on a back surface of the light housing; the light assembly further including a transparent lens, a mirror reflector, and a lamp control circuit having an illumination lamp; the light housing defining an interior housing compartment and including a battery compartment cover and an angled lens support frame oriented at an acute angle with respect to the back surface side edge of the light housing; the illumination lamp being installed within the interior housing compartment; the angled lens support frame having a perimeter lens retaining channel within which edges of the transparent plastic lens are supported and retained; the mirror reflector having a mirror surface and being installed within the interior housing compartment in planar parallel orientation with the transparent plastic lens and behind the illumination lamp with the mirror surface oriented toward the illumination lamp to reflect light from the illumination lamp out through the transparent plastic lens; the lamp control circuit including a non-retriggerable timer circuit, a period determining circuit, a momentary contact light activation switch, a power switching device, a battery power supply and the illumination lamp; the non-retriggerable timer circuit, the period determining circuit, the power switching device, the battery power supply and the illumination lamp being positioned within the light housing; the momentary contact light activation switch be mounted to an exterior surface of the light housing; the non-retriggerable timer circuit including a period determining circuit input, an activation input, and a timed control output; the period determining circuit being in connection with the period determining circuit input of the non-retriggerable timer circuit; the momentary contact light activation switch being in electrical connection with the activation input of the timed control output non-retriggerable timer circuit; the power switching device having two normally open power connection terminals controlled by a switching control input that is electrically connected to the timed control output of the non-retriggerable timer circuit; the illumination lamp being in series electrical connection with the battery power supply and the two normally open power connection terminals of the power switching device; the lamp control circuit supplying power to the illumination lamp for a predetermined period of time after closing of the momentary contact light activation switch.

BACKGROUND ART

It is often difficult to locate an item in a purse, such as a hand bag, carry all, makeup case, or the like, because the interior of the purse is dark and crowded with many items. It would be a benefit, therefore, to have a light system that could be detachably installed within the purse to provide light to the interior of the purse while searching for an item and which could be detached and used to illuminated keyholes and the like if desired. Because purses are typically crowded with a large number of items, a switch activated light can be accidentally activated and drained of power by contact with an item within the purse. It would be a further benefit, therefore, to have a light system that included a lamp control circuit including an illumination lamp that could be activated for a predetermined period of time by closing a momentary contact switch and which could not be reactivated until the momentary contact switch was released and the predetermined period of time had elapsed to prevent accidental draining of the light system battery power supply.

GENERAL SUMMARY DISCUSSION OF INVENTION

It is thus an object of the invention to provide a purse light system that is detachably mountable within a purse.

It is a further object of the invention to provide a purse light system that includes a lamp control circuit including an illumination lamp that is activated for a predetermined period of time by closing a momentary contact switch and which is not reactivateable until the momentary contact switch is released and the predetermined period of time has elapsed to prevent accidental draining of the light system battery power supply.

It is a still further object of the invention to provide a purse light system that includes a hook and pile adhesive backed purse attachment strip with a peel off backing and a light assembly having a light housing that is securable to the purse attachment strip with a hook and pile housing fastener strip, companionate with the hook and pile purse attachment strip, provided on a back surface of the light housing; the light assembly further including a transparent lens, a mirror reflector, and a lamp control circuit having an illumination lamp; the light housing defining an interior housing compartment and including a battery compartment cover and an angled lens support frame oriented at an acute angle with respect to the back surface side edge of the light housing; the illumination lamp being installed within the interior housing compartment; the angled lens support frame having a perimeter lens retaining channel within which edges of the transparent plastic lens are supported and retained; the mirror reflector having a mirror surface and being installed within the interior housing compartment in planar parallel orientation with the transparent plastic lens and behind the illumination lamp with the mirror surface oriented toward the illumination lamp to reflect light from the illumination lamp out through the transparent plastic lens; the lamp control circuit including a non-retriggerable timer circuit, a period determining circuit, a momentary contact light activation switch, a power switching device, a battery power supply and the illumination lamp; the non-retriggerable timer circuit, the period determining circuit, the power switching device, the battery power supply and the illumination lamp being positioned within the light housing; the momentary contact light activation switch be mounted to an exterior surface of the light housing; the non-retriggerable timer circuit including a period determining circuit input, an activation input, and a timed control output; the period determining circuit being in connection with the period determining circuit input of the non-retriggerable timer circuit; the momentary contact light activation switch being in electrical connection with the activation input of the timed control output non-retriggerable timer circuit; the power switching device having two normally open power connection terminals controlled by a switching control input that is electrically connected to the timed control output of the non-retriggerable timer circuit; the illumination lamp being in series electrical connection with the battery power supply and the two normally open power connection terminals of the power switching device; the lamp control circuit supplying power to the illumination lamp for a predetermined period of time after closing of the momentary contact light activation switch.

It is a still further object of the invention to provide a purse light system that accomplishes some or all of the above objects in combination.

Accordingly, a purse light system is provided. The purse light system includes a hook and pile adhesive backed purse attachment strip with a peel off backing and a light assembly having a light housing that is securable to the purse attachment strip with a hook and pile housing fastener strip, companionate with the hook and pile purse attachment strip, provided on a back surface of the light housing; the light assembly further including a transparent lens, a mirror reflector, and a lamp control circuit having an illumination lamp; the light housing defining an interior housing compartment and including a battery compartment cover and an angled lens support frame oriented at an acute angle with respect to the back surface side edge of the light housing; the illumination lamp being installed within the interior housing compartment; the angled lens support frame having a perimeter lens retaining channel within which edges of the transparent plastic lens are supported and retained; the mirror reflector having a mirror surface and being installed within the interior housing compartment in planar parallel orientation with the transparent plastic lens and behind the illumination lamp with the mirror surface oriented toward the illumination lamp to reflect light from the illumination lamp out through the transparent plastic lens; the lamp control circuit including a non-retriggerable timer circuit, a period determining circuit, a momentary contact light activation switch, a power switching device, a battery power supply and the illumination lamp; the non-retriggerable timer circuit, the period determining circuit, the power switching device, the battery power supply and the illumination lamp being positioned within the light housing; the momentary contact light activation switch be mounted to an exterior surface of the light housing; the non-retriggerable timer circuit including a period determining circuit input, an activation input, and a timed control output; the period determining circuit being in connection with the period determining circuit input of the non-retriggerable timer circuit; the momentary contact light activation switch being in electrical connection with the activation input of the timed control output non-retriggerable timer circuit; the power switching device having two normally open power connection terminals controlled by a switching control input that is electrically connected to the timed control output of the non-retriggerable timer circuit; the illumination lamp being in series electrical connection with the battery power supply and the two normally open power connection terminals of the power switching device; the lamp control circuit supplying power to the illumination lamp for a predetermined period of time after closing of the momentary contact light activation switch.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
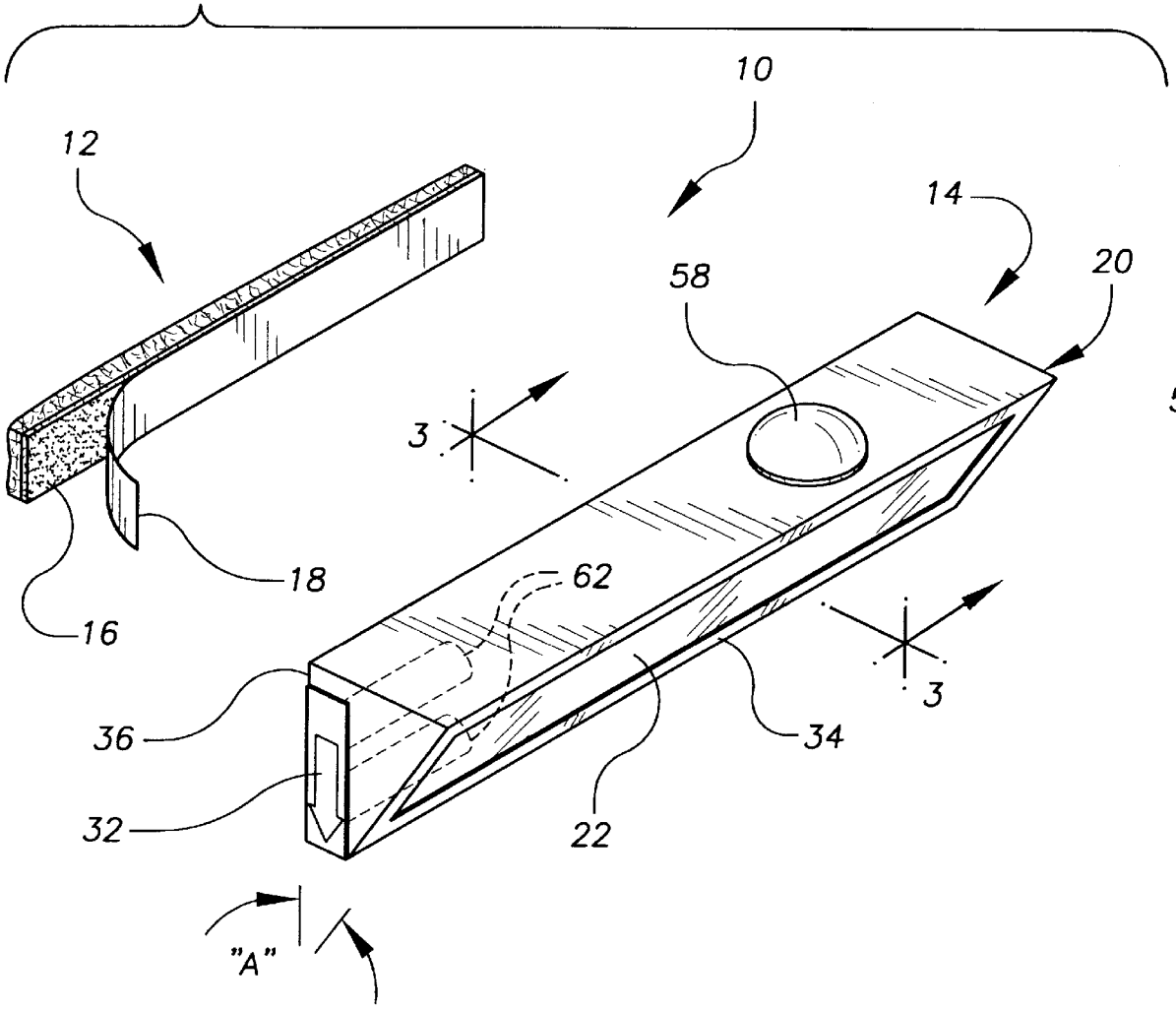
FIG. 1 is a perspective view of an exemplary embodiment of the purse light of the present invention showing the hook and pile purse attachment strip with the peel off backing; and the light assembly including the plastic light housing with the battery compartment cover, the momentary contact light activation switch, the angled lens support frame oriented at an acute angle with respect to a back surface side edge of the light housing, and the transparent plastic lens supported at an angle within the angled lens support frame.

FIG. 1 shows an exemplary embodiment of the purse light system of the present invention, generally designated 10. Purse light system 10 includes a hook and pile purse attachment strip, generally designated 12; and a light assembly, generally designated 14. Hook and pile purse attachment strip 12 has an adhesive back surface 16 and a peel off backing 18 that is removed prior to sticking adhesive back surface 16 to the interior wall of a purse.

Figure 3:
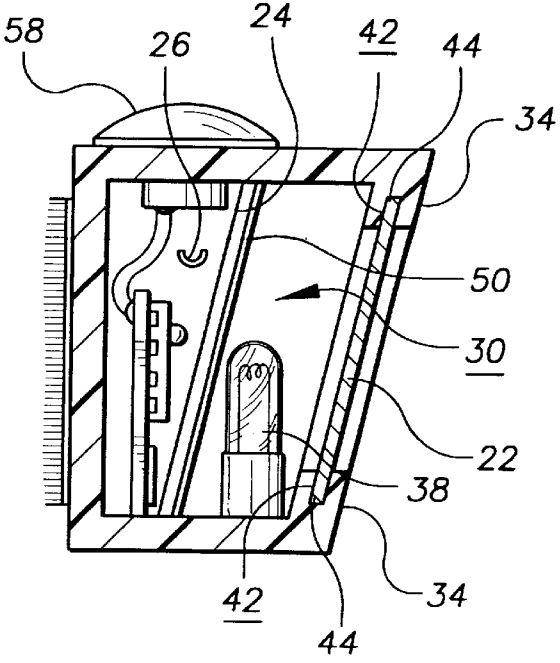
FIG. 3 is section view of the light assembly of FIG. 1 showing the plastic light housing, the hook and pile housing fastener strip, companionate with the hook and pile purse attachment strip, secured to the back surface of the light housing; the circuit compartment defined within the light housing; the momentary contact light activation switch connected to the lamp control circuit positioned within the circuit compartment; the perimeter lens retaining channel of the angled lens support frame; the edges of the transparent plastic lens supported within the perimeter lens retaining channel of the angled lens support frame, one of the two illumination lamps; and the mirror finish reflector installed within the housing in planar parallel orientation with the transparent plastic lens and behind the illumination lamps with the mirror surface oriented toward the illumination lamps to reflect light from the illumination lamps out through the transparent plastic lens.

Light assembly 14 includes a molded plastic light housing, generally designated 20; a transparent lens 22; a mirror reflector 24 (FIG. 3); and a lamp control circuit, generally designated 26 (FIG. 3). Light housing 20 has an interior housing compartment 30 (FIG. 3) formed therein, a battery compartment cover 32 and, an angled lens support frame 34 (See also FIG. 2) that is oriented at an acute angle "A" of thirty degrees with respect to a back surface side edge 36 of light housing 20.

Figure 2:
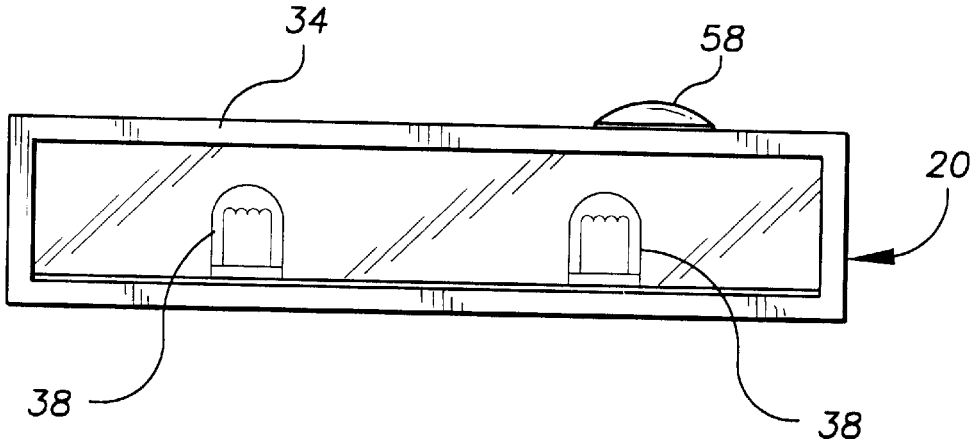
FIG. 2 is a front plan view showing the momentary contact light activation switch, the angled lens support frame, the transparent plastic lens supported at an angle within the angled lens support frame, the two illumination lamps, and the mirror finish reflector installed within the housing behind the illumination lamps to reflect light from the illumination lamps out through the transparent plastic lens.

With reference to FIG. 2, two illumination lamps 38, referring now to FIG. 3, are installed within interior housing compartment 30. Angled lens support frame 34 has a perimeter lens retaining channel 42 within which edges 44 of transparent plastic lens 22 are supported and retained. Mirror reflector 24 has a mirror surface 50 and is installed within interior housing compartment 30 in planar parallel orientation with transparent plastic lens 22 and behind illumination lamps 38.

Figure 4:
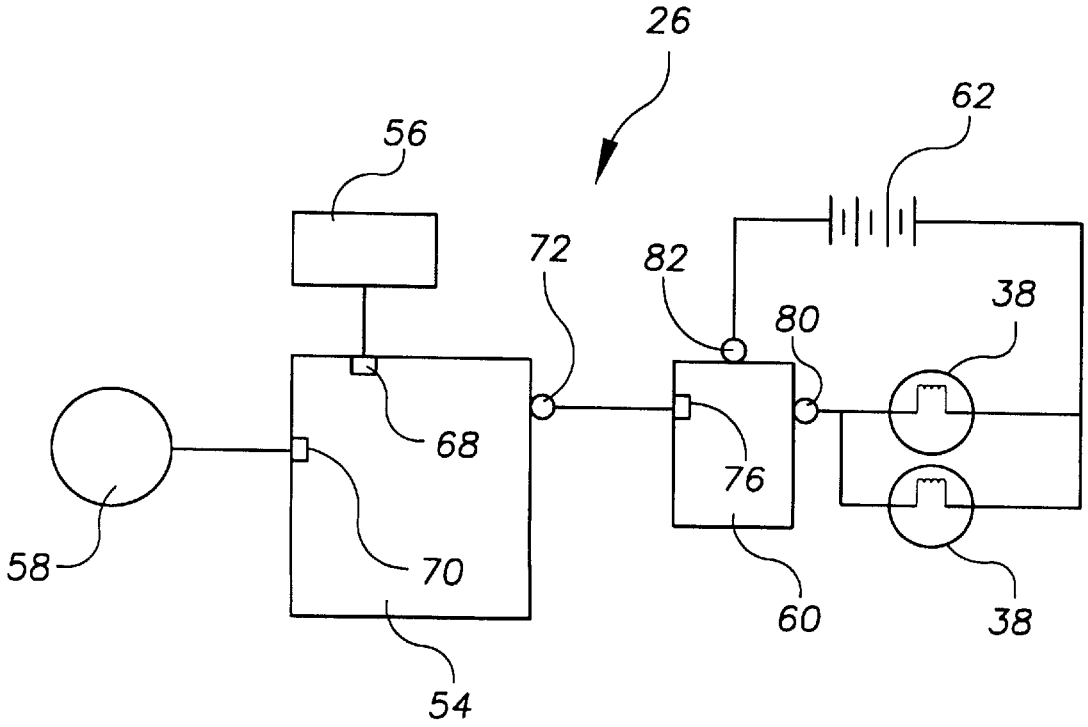
FIG. 4 is a schematic diagram of the lamp control circuit showing the non-retriggerable timer circuit including the period determining circuit input, the activation input, and the timed control output; a period determining circuit in connection with the period determining circuit input of the non-retriggerable timer circuit; a momentary contact light activation switch in electrical connection with the activation input of the timed control output non-retriggerable timer circuit; a power switching device having two normally open power connection terminals controlled by a switching control input that is electrically connected to the timed control output of the non-retriggerable timer circuit; and the two illumination lamps in series connection with the battery power supply and the two normally open power connection terminals of the power switching device.

Referring now to FIG. 4, lamp control circuit, generally designated 26, includes a non-retriggerable timer circuit 54, a period determining circuit 56, a momentary contact light activation switch 58 (see also FIGS. 1,2,3), a power switching device 60, a battery power supply 62 and the two illumination lamps 38. Non-retriggerable timer circuit 54 is a conventional non-retriggerable flip-flop circuit. Period determining circuit 56 is a conventional RC network. Power switching device 60 is a solid state relay. Momentary contact light activation switch 58 is mounted to an exterior surface of the light housing 20 (FIGS. 1–3) to provide access to the user. Non-retriggerable timer circuit 54 includes a period determining circuit input 68, an activation input 70, and a timed control output 72.

Depressing momentary contact light activation switch 58 triggers non-retriggerable timer circuit 54 to generate an "on" signal at timed control output 72 for a predetermined period determined by the resistive and capacitive components of period determining circuit 56. Timed control output 72 is connected to the switching control input 76 of power switching device 60. An "on" signal at switching control input 76 causes a closed circuit between two normally open power connection terminals 80, 82 completing the circuit between battery power supply 62 and illumination lamps 38 causing illumination lamps to light. Once the predetermined period has elapsed, the "on" signal is no longer present causing the normally open power connection terminals 80, 82 to return to the open condition breaking the circuit between battery supply 62 and illumination lamps 38.

It can be seen from the preceding description that a purse light system has been provided that is detachably mountable within a purse; that includes a lamp control circuit including an illumination lamp that is activated for a predetermined period of time by closing a momentary contact switch and which is not reactivateable until the momentary contact switch is released and the predetermined period of time has elapsed to prevent accidental draining of the light system battery power supply; and that includes a hook and pile adhesive backed purse attachment strip with a peel off backing and a light assembly having a light housing that is securable to the purse attachment strip with a hook and pile housing fastener strip, companionate with the hook and pile purse attachment strip, provided on a back surface of the light housing; the light assembly further including a transparent lens, a mirror reflector, and a lamp control circuit having an illumination lamp; the light housing defining an interior housing compartment and including a battery compartment cover and an angled lens support frame oriented at an acute angle with respect to the back surface side edge of the light housing; the illumination lamp being installed within the interior housing compartment; the angled lens support frame having a perimeter lens retaining channel within which edges of the transparent plastic lens are supported and retained; the mirror reflector having a mirror surface and being installed within the interior housing compartment in planar parallel orientation with the transparent plastic lens and behind the illumination lamp with the mirror surface oriented toward the illumination lamp to reflect light from the illumination lamp out through the transparent plastic lens; the lamp control circuit including a non-retriggerable timer circuit, a period determining circuit, a momentary contact light activation switch, a power switching device, a battery power supply and the illumination lamp; the non-retriggerable timer circuit, the period determining circuit, the power switching device, the battery power supply and the illumination lamp being positioned within the light housing; the momentary contact light activation switch be mounted to an exterior surface of the light housing; the non-retriggerable timer circuit including a period determining circuit input, an activation input, and a timed control output; the period determining circuit being in connection with the period determining circuit input of the non-retriggerable timer circuit; the momentary contact light activation switch being in electrical connection with the activation input of the timed control output non-retriggerable timer circuit; the power switching device having two normally open power connection terminals controlled by a switching control input that is electrically connected to the timed control output of the non-retriggerable timer circuit; the illumination lamp being in series electrical connection with the battery power supply and the two normally open power connection terminals of the power switching device; the lamp control circuit supplying power to the illumination lamp for a predetermined period of time after closing of the momentary contact light activation switch.

It is noted that the embodiment of the purse light system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A purse light system comprising:

a light assembly including a light housing, a transparent lens, a mirror reflector, and a lamp control circuit having an illumination lamp;

said light housing defining an interior housing compartment and including a battery compartment cover and an angled lens support frame oriented at an acute angle with respect to said back surface side edge of said light housing;

said illumination lamp being installed within said interior housing compartment;

said angled lens support frame having a perimeter lens retaining channel within which edges of said transparent plastic lens are supported and retained;

said mirror reflector having a mirror surface and being installed within said interior housing compartment in planar parallel orientation with said transparent plastic lens and behind said illumination lamp with said mirror surface oriented toward said illumination lamp to reflect light from said illumination lamp out through said transparent plastic lens;

said lamp control circuit including a non-retriggerable timer circuit, a period determining circuit, a momentary contact light activation switch, a power switching device, a battery power supply and said illumination lamp;

said non-retriggerable timer circuit, said period determining circuit, said power switching device, said battery power supply and said illumination lamp being positioned within said light housing;

said momentary contact light activation switch be mounted to an exterior surface of said light housing;

said non-retriggerable timer circuit including a period determining circuit input, an activation input, and a timed control output;

said period determining circuit being in connection with said period determining circuit input of said non-retriggerable timer circuit and transmitting a signal to said non-retriggerable timer circuit setting a predetermined time period;

said momentary contact light activation switch being in electrical connection with said activation input of said timed control output non-retriggerable timer circuit;

said power switching device having two normally open power connection terminals controlled by a switching control input that is electrically connected to said timed control output of said non-retriggerable timer circuit;

said illumination lamp being in series electrical connection with said battery power supply and said two normally open power connection terminals of said power switching device;

said lamp control circuit supplying power to said illumination lamp for said predetermined time period after closing of said momentary contact light activation switch.

2. The purse light system of claim 1 further comprising:

a hook and pile adhesive backed purse attachment strip with a peel off backing; and wherein said light housing is securable to said purse attachment strip with a hook and pile housing fastener strip, companionate with said hook and pile purse attachment strip, provided on a back surface of said light housing.

* * * * *